US007082879B2

(12) United States Patent
Alt

(10) Patent No.: US 7,082,879 B2
(45) Date of Patent: Aug. 1, 2006

(54) METHOD FOR A SINGLE GUIDELANE, BIDIRECTIONAL, PASSENGER CARRYING TRAMCAR SYSTEM

(76) Inventor: John D. Alt, 209 Main St., Annapolis, MD (US) 21401

( * ) Notice: Subject to any disclaimer, the term of this patent is extended or adjusted under 35 U.S.C. 154(b) by 0 days.

(21) Appl. No.: 10/867,141

(22) Filed: Jun. 14, 2004

(65) Prior Publication Data

US 2005/0274277 A1 Dec. 15, 2005

(51) Int. Cl.
*B61J 3/00* (2006.01)
*B61C 11/00* (2006.01)

(52) U.S. Cl. ..... 104/88.01; 105/72.2

(58) Field of Classification Search ..... 104/88.01, 104/88.03, 88.05, 88.06, 130.09, 139; 105/72.2, 105/177

See application file for complete search history.

(56) References Cited

U.S. PATENT DOCUMENTS 5,611,282 A 3/1997 Alt
5,676,059 A * 10/1997 Alt ..... 104/88.06
2003/0137435 A1* 7/2003 Haddad et al. ..... 340/994

* cited by examiner

*Primary Examiner*—S. Joseph Morano
*Assistant Examiner*—Robert J. McCarry, Jr.
(74) *Attorney, Agent, or Firm*—Arthur Schwartz

(57) ABSTRACT

The invention is a method of coordinating the movement of a plurality of oppositely directed tramcars operating along a single guidelane. This includes positioning a plurality of fixed stop-boarding areas along the guidelane. By-pass lanes enabling oppositely moving tramcars to pass each other are located in association with at least some of the stop-boarding areas. A predetermined arrival time for each tramcar at each stop-boarding area is calculated such that oppositely moving pairs of tramcars approaching a common stop-boarding area will arrive at approximately the same time. A processor onboard each tramcar calculates the distance and time remaining to the next stop-boarding area. With a known time and distance remaining to the next stop-boarding area, each on-board processor adjusts the speed of the tramcar such that it arrives at approximately the predetermined arrival time.

41 Claims, 9 Drawing Sheets

METHOD FOR A SINGLE GUIDELANE, BIDIRECTIONAL, PASSENGER CARRYING TRAMCAR SYSTEM

BACKGROUND OF THE INVENTION

The present invention relates to passenger-carrying transit systems which operate in a single guidelane dedicated only to the transit system and not shared with other vehicles; in which multiple passenger-carrying vehicles (hereinafter referred to as "tramcars") operate in both directions along the single, dedicated guidelane; in which the movement of the multiple tramcars is coordinated such that oppositely moving tramcars only meet each other at a tram-stop boarding area, where passengers embark and debark the tramcars, and where a short bypass is provided in the guidelane enabling one tramcar to go around the other prior to, or after, passenger embarking and debarking is complete; in which the movement of the multiple tramcars is further coordinated such that oppositely moving tramcars always arrive at a mutual tram-stop boarding area at substantially the same moment; and in which this coordinated, synchronous arrival is maintained in spite of random delay events experienced by one or more of the tramcars within the system (caused, for example, by having to slow down or stop when other vehicles or pedestrians inadvertently encroach upon, or cross, the tramcar's guidelane.)

The principal benefit of the synchronous tramcar arrivals is a very high convenience level for system users. Without synchronous arrivals, passengers would board the first tramcar to arrive at any given tram-stop boarding area, but would then have to wait for the oncoming tramcar to also arrive before the car they had just boarded would be able to bypass and continue. This unpredictable waiting period would make the system feel inconvenient, and discourage ridership. Synchronous arrivals, in contrast, would make the system feel highly convenient and encourage ridership.

The above method of coordinating the movement of multiple, passenger-carrying tramcars in a single, dedicated guidelane is able to produce very high people-moving capacities for two reasons: First, since the tramcars do not share lane space with other traffic, they do not experience the delays of local traffic congestion. Second, at full capacity, tramcars arrive at the tram-stop boarding areas with very high frequency. While dual-guidelane systems can achieve equal people-moving capacity, the single guidelane method described has the following advantages: (1) capital costs are reduced since only a single guidelane need be constructed; (2) a smaller footprint or right-of-way is required since the method utilizes only one guidelane rather than two; (3) passengers are provided the convenience of being able to board a tramcar going in either direction from a single tram-stop boarding area;

Finally, the above method has a significant advantage over Automated People-Mover systems which, for reasons of public safety, must be elevated above, or otherwise separated from the possibility of pedestrian or vehicular intrusion into their guidelanes. In contrast, the above method—in which the tramcars are able to slow or stop in response to unpredicted, inadvertent pedestrian or vehicular guidelane encroachment—enables the system to operate safely on the same grade with, and in close proximity to, pedestrian and vehicular traffic.

DESCRIPTION OF THE PRIOR ART

It is known from my prior U.S. Pat. Nos. 5,611,282 and 5,676,059, which are herein incorporated by reference, to coordinate the movement of multiple tramcars, moving in both directions along a single, dedicated guidelane, such that oppositely moving tramcars only meet each other at tram-stop boarding areas, and are further coordinated such that the oppositely moving tramcars always arrive at mutual tram-stop boarding areas at substantially the same moment. A short bypass in the guidelane or guidelane associated with each tramstop allows the tramcars to then bypass each other just prior to, or just after, passengers have embarked and debarked at the boarding area, thus enabling the tramcars in the system to (1) move continuously in their opposite directions without colliding and (2) ensuring the tramcars bypass each other without having to incur the delay of waiting for an oncoming tramcar to arrive. The method described in the referenced patents applied to both substantially linear guidelane configurations, in which the tramcars reverse direction at each end-stop, and loop configurations in which one set of tramcars moves continuously in one direction around the loop, and another set of tramcars moves continuously in the opposite direction.

In the referenced patents, however, the method of coordinating the movement of the tramcars requires a plurality of sensors along the guidelane which sense the location of the tramcars, the sensed tramcar locations then being communicated to a central processor which, in turn, communicates back to one or more of the tramcars, adjusting its speed, such that any two tramcars moving toward a mutual tram-stop boarding area would arrive at substantially the same moment. This method has the disadvantage of requiring multiple sensors along the guidelane which must be hard-wired to a central processor, or which must utilize multiple wireless transmitters, and which also must distinguish between tramcars moving in opposite directions. It also has the disadvantage that the optimal spacing of sensors along the guidelane is dependent upon the tramcar speed, whereas the tramcar speed is variable.

An alternate method of sensing the location of the tramcars would be the utilization of GPS (Global Positioning System) technology. This, however, has two disadvantages: (1) GPS signals are often intermittent in urban areas with densely arrayed tall buildings—the kind of location this kind of people-mover is likely to be deployed—and (2) GPS accuracy is currently ±/−10 meters, which would cause tramcars to regularly experience at least some delay having to wait for an oncoming tramcar to arrive at a tram-stop bypass.

The prior art, then, does not show how to coordinate the synchronous arrivals of the oppositely moving tramcars without utilizing either guidelane sensors or utilizing GPS technology to communicate tramcar locations to a central processor.

The prior art also does not show how, once such a system begins operations, tramcars can be removed from the system to reduce operating costs during periods of low demand, or how tramcars can then be added back into the system during periods of peak demand, without interrupting the coordinated, synchronous arrivals of the system as a whole.

The prior art also does not show how such a system can maintain passenger-carrying operations, with synchronous arrivals at tram-stop boarding areas, if there is a mechanical breakdown or accident which blocks the guidelane for an extended period of time.

Finally, the prior art does not show how such a system, if operating in a city streetscape, could traverse signalized street intersections without each red-light incidence introducing a significant delay into the synchronous arrival sequence; or without signal pre-emption by the tramcars creating frequent and random traffic-signal cycling, causing delays and aggravation for the drivers of other vehicles, and possibly aggravating traffic congestion.

SUMMARY OF THE INVENTION

It is an object of the present invention, then, to create a high capacity, highly convenient, passenger-carrying tramcar system which can operate safely in a single, dedicated guidelane, on-grade, in close proximity with vehicular and pedestrian traffic; and which eliminates the described disadvantages and deficiencies of the prior art.

With reference to this intention, an object of the present invention is to show a method of coordinating multiple tramcars, moving in opposite directions along a single, dedicated guidelane, such that oppositely moving tramcars arrive at mutual tram-stop bypass/boarding areas at substantially the same moment, without utilizing either location sensors along the guidelane, or GPS technology.

A further object of the invention is to show specifically how this "sensorless" method maintains tramcar coordination in the event that one or more tramcars are randomly delayed in their operation (for example, by vehicular or pedestrian activity temporarily encroaching on the guidelane).

A further object of the invention is to show specifically how this "sensorless" method can accommodate the dynamic adding of tramcars into the system (to accommodate peak-demand periods) or the dynamic removal of tramcars from the system (to reduce operating costs in periods of reduced demand) without disrupting the on-going synchronous arrivals within the system.

A further object of the invention is to show specifically how such a system, coordinated by this "sensorless" method, would maintain passenger-carrying services and synchronous arrivals in the event an accident or mechanical breakdown blocks the single, dedicated guidelane.

A final object of the invention is to show how such a system, coordinated by this "sensorless" method, can traverse signalized intersections, without being unduly delayed by red-lights and without causing frequent and random traffic-signal cycling.

BRIEF DESCRIPTION OF THE DRAWINGS

The present invention will be more fully understood by reference to the following detailed description thereof when read in conjunction with the attached drawings, and wherein.

DETAILED DESCRIPTIONS OF THE DRAWINGS

Figure 1:
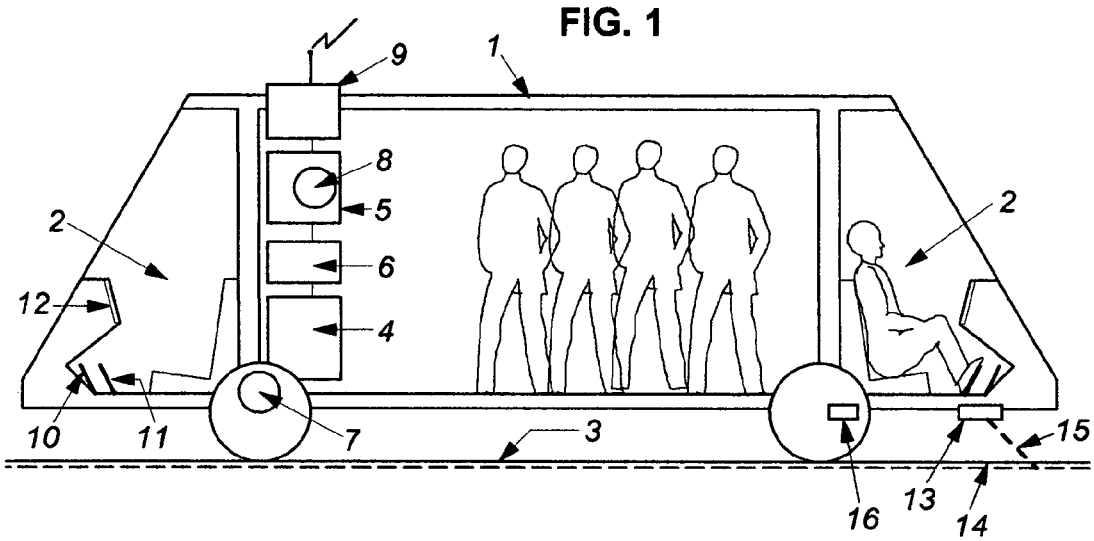
FIG. 1 is a diagrammatic sectional side view of a passenger carrying tramcar which operates within a guidelane in coordination with other, identical or similar tramcars, and which may operate bidirectionally within that guidelane.
Figure 1A:
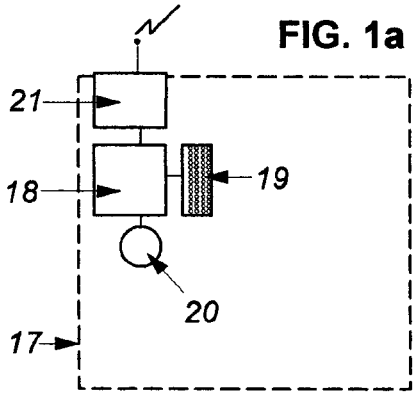
FIG. 1*a* is a diagrammatic plan view of an associated central control facility which may be spatially remote from the guidelane and tramcars.

Referring to FIG. 1 the present invention includes a plurality of passenger carrying vehicles ("tramcars") 1 which may be bidirectional, with an operator cockpit 2 at each end, and which operate in both directions along a single guidelane 3. Looking further at FIG. 1, each tramcar includes a motor drive means 4 which provides propulsion, a programmable on-board processor 5, a motor controller 6 which initiates speed changes and predetermined acceleration/deceleration rates, an odometer 7 which measures distance traveled, a clock 8 which measures elapsed time, and a transceiver 9—all integrated and/or conFigured to communicate with each other as will be later described. Looking further at FIG. 1, each operator cockpit includes an operator actuated accelerator 10, an operator actuated brake pedal 11, and an operator information display 12. It can be understood that the tramcars herein referred to may operate on fixed rails, such that the tramcars follow the path of the rails. Alternatively, it can be understood, referring again to FIG. 1, that each tramcar may include a mechanical, optical or electromagnetic sensor 13 which is linked to, or senses 15 a mechanical, optical or electromagnetic guide target 14 imbedded within or upon the guidelane 3, and which causes a steering motor 16 to guide the tramcar along the path of the target. Referring to FIG. 1*a* the present invention includes a central control facility 17 equipped with a central control processor 18, a central control processor input device 19, a system clock 20, and an associated transceiver 21.

Figures 2, 3, 4, 5, 6, 7:
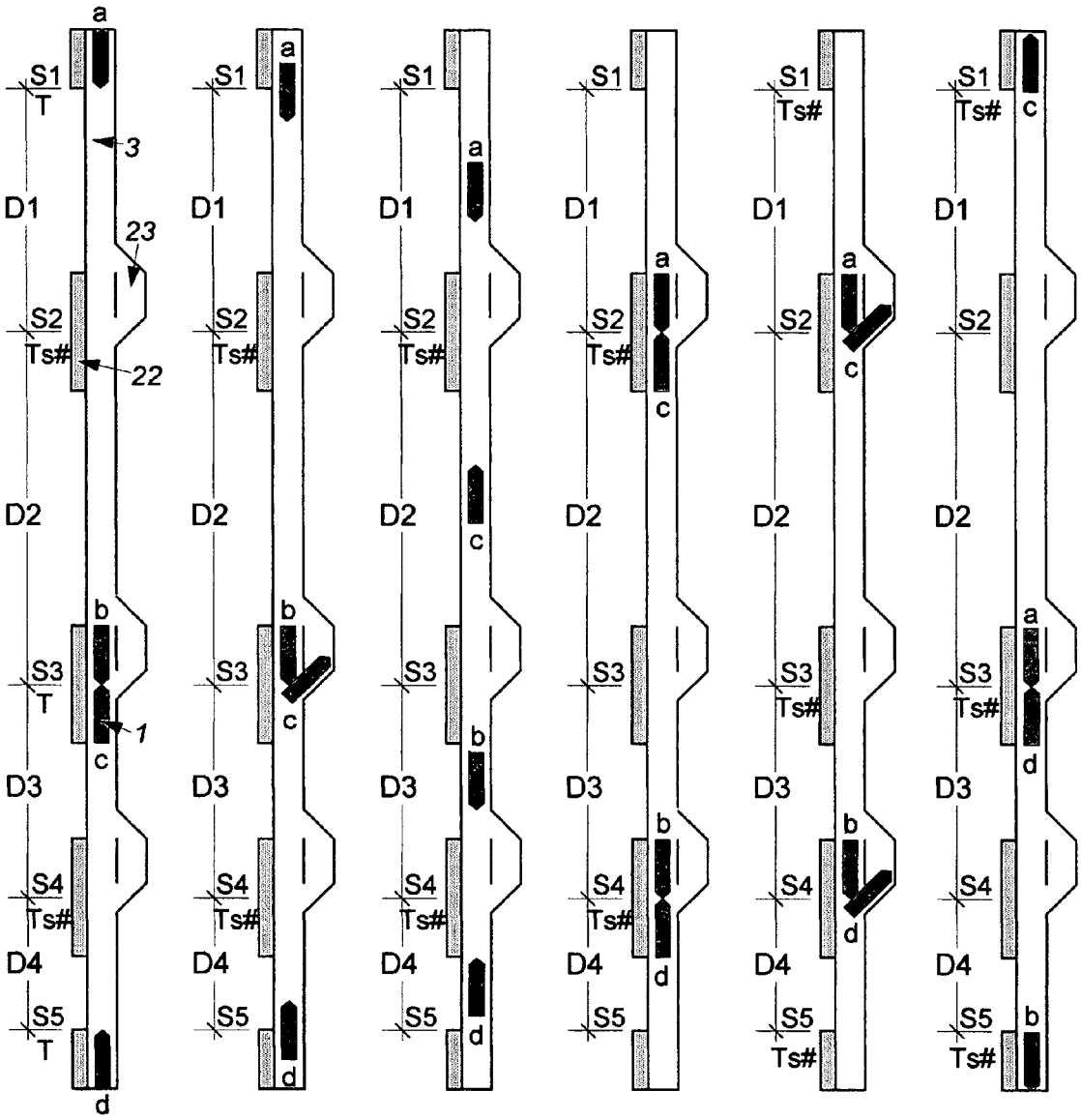
FIG. 2 is a diagrammatic plan view of a single, guidelane passenger carrying tramcar system which includes multiple tramcars and multiple stop boarding areas, some of which have associated guidelane bypass segments.
FIGS. 3 through 27 show certain sequential positions of tramcars operating in the system and, in some of these Figures, certain communications, indicated by quotation marks, between tramcars and the central control facility, it being understood that, for purposes of illustration, the central control facility is not shown in Figures where no such communications occur.

Referring now to FIG. 2, the present invention is shown in diagrammatic plan view in which is shown the guidelane 3, and also a plurality of tram-stop boarding areas 22 and associated bypass guidelane segments 23. Looking further at FIG. 2 it will be noted that the tramcars 1 are shown with a pointed end to diagrammatically indicate the direction each tramcar is traveling. Looking further at FIG. 2 it will be noted that the tramcars are labeled "a", "b", "c" and "d" to enable their relative positions to be followed in subsequent diagrams. It will be further noted that the tram-stop boarding areas are labeled "S1", "S2", "S3", "S4" and "S5", and that boarding areas "S2" through "S4" are each of a length to accommodate two tramcars, and each also has an associated bypass guidelane segment 23, whereas boarding areas "S1" and "S5", being end stops, are of a length to accommodate a single tramcar and do not have bypass segments. Looking further at FIG. 2 it will be noted that the tram-stop boarding areas are separated by fixed distances labeled "D1", "D2", "D3" and "D4", and it will be understood that these distances may be different.

Referring to FIGS. 2–7, basic system operations can be understood as follows: At system startup, all onboard clocks 8 are synchronized with the system clock 20, and each onboard processor 5 is preprogrammed with a schedule time at which that tramcar is supposed to arrive, in sequence, at each stop boarding area along the guidelane. For the purposes of these diagrammatic illustrations, schedule time is designated "Ts#", where s= a number of seconds after synchronized system start-up, and # indicates the particular stop boarding area that arrival time pertains to. Each onboard processor is also preprogrammed with the exact distance "Dx" between each stop boarding area, and the onboard odometer 7 causes that distance to be reduced in the processor as the tramcar moves along the guidelane. Thus, by comparing the distance and time remaining to the next stop boarding area, the onboard processor is able to calculate the speed required to arrive at time "Ts#". This calculated speed is then used by the onboard motor controller 6 such that when the tramcar operator engages the accelerator 10 the motor controller causes the tramcar to accelerate, at a predetermined acceleration rate, to the calculated speed. As the tramcar approaches the next stop boarding area, the onboard processor, using a predetermined deceleration rate, calculates the distance from the stop boarding area that deceleration must begin, and causes the motor controller to commence deceleration at that point, such that the tramcar arrives and stops at the next stop boarding area at time "Ts#". It will be understood that since tramcars approaching the same stop boarding area from opposite directions will be following the above described procedure, they will arrive and stop, facing each other, at substantially the same moment. After passengers have deboarded and boarded, one tramcar will then utilize the bypass segment associated with the stop boarding area, and the tramcars will depart, continuing in their opposite directions. The importance of the synchronized arrivals at stop boarding areas will be understood as being the elimination of the passenger inconvenience of boarding a tramcar and then having to await the arrival of the oncoming tramcar before being able to depart.

Referring to FIG. 2, it will be noted that this is a preferred distribution of tramcars at operation startup, the distribution being a tramcar at each end stop boarding area, and pairs of tramcars facing each other at intermediate stop boarding areas, the distribution including at least one—and always an odd number—of empty tram-stop boarding areas between what will become oppositely moving tramcars at actual system startup. Referring to FIG. 2 it will be understood that there is no theoretical limit to the number of stop boarding areas in a given system, but that the maximum number of tramcars which can be deployed in a given system is equal to one less than the total number of stop boarding areas. It will be further understood that tramcars going in one direction, "c" and "d" in this case, will always utilize the bypass guidelane segments, and tramcars going in the opposite direction, "a" and "b", in this case, will always continue straight along the guidelane.

Referring to the sequence of FIGS. 2–7, it will be understood that at a predetermined start-up time "T" all tramcars will open their doors and take on passengers. When boarding is complete, tramcar operators will engage their accelerators 10 and the onboard motor controller 6 on each tramcar, directed by the onboard processor 5 on each tramcar, will cause each tramcar to accelerate to a calculated speed to arrive at their next stop boarding area at time "Ts#". It will be noted in FIG. 3 that tramcars utilizing the bypass segment, in this case tramcar "c", will accelerate first, providing the opposing tramcar, in this case "b", with a clear guidelane. FIG. 4 shows all tram cars now proceeding to their next stop boarding area with the scheduled arrival time of "Ts#". FIG. 5 shows tramcars "a" and "c", and "b" and "d" having thus arrived at substantially the same moment at their respective stop boarding areas "S2" and "S4". After passengers have deboarded and boarded, in this case as shown in FIG. 6, tramcars "d" and "c" enter their respective bypass segments, and the tramcars all accelerate toward their next stop boarding area, scheduled to arrive at time "Ts#". FIG. 7 shows the tramcars having arrived, at the scheduled arrival time of "Ts#", at their respective stop boarding areas "S1", "S3" and "S5". Referring to FIG. 7, it will be understood that tramcars "b" and "c", having arrived at endstops, will now reverse direction. Thus, it can be visualized that the general distribution of tramcars in FIG. 7, with a tramcar at each endstop and two tramcars, facing each other, at intermediate stop "S3", duplicates the startup distribution shown in FIG. 2. Further cycles of the system will thus repeat what has been described above.

Referring to FIGS. 2–7, it can be understood that the system shown and described will operate continuously, with synchronous arrivals at stop boarding areas, as long as none of the tramcars is delayed, either between stop boarding areas or during the deboarding and boarding process. Such delays could be caused by pedestrian or other vehicle activity crossing the guidelane which, for safety reasons, causes the tramcar operator to slow down, or stop.

Figures 8, 9, 10, 11:
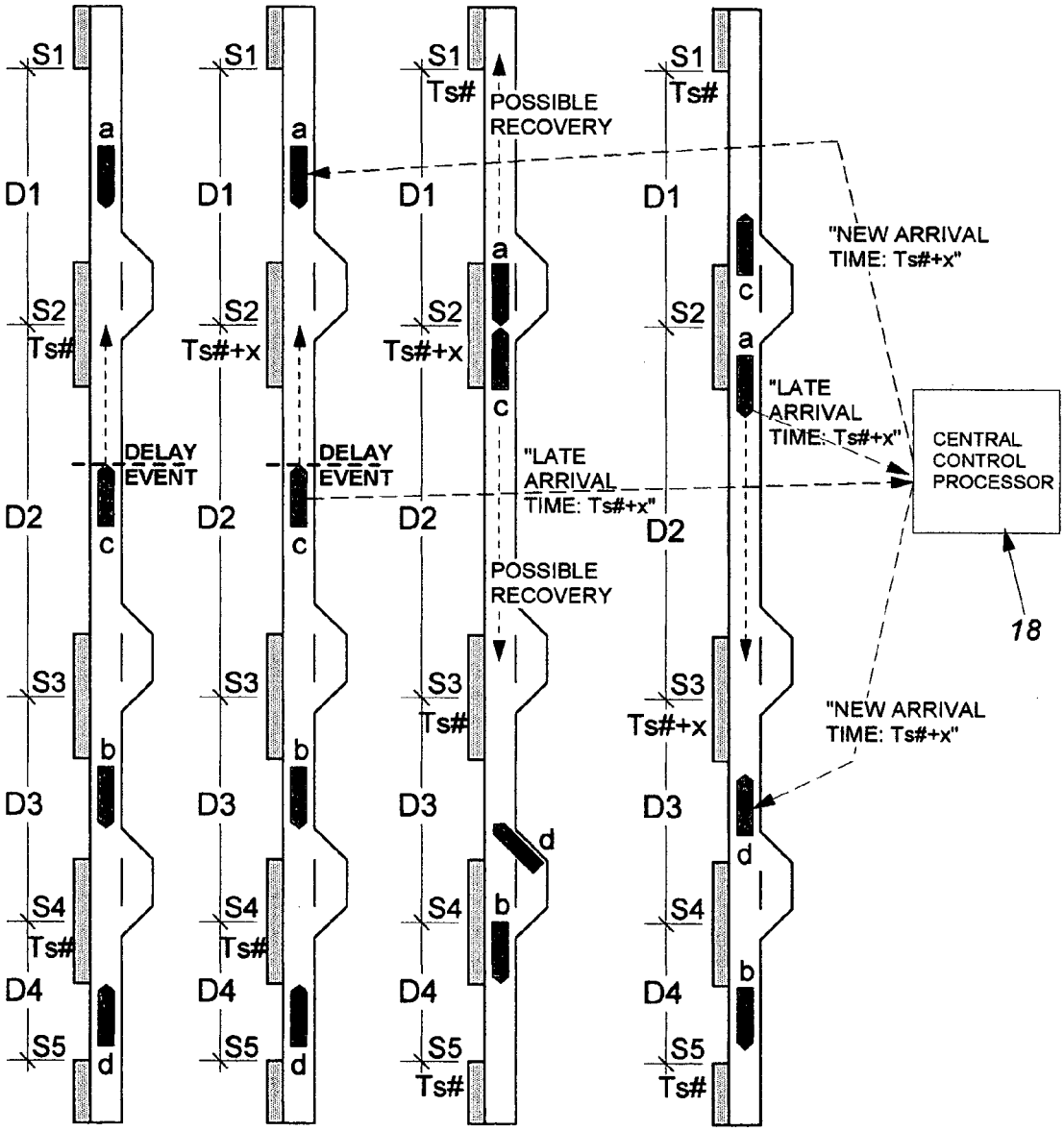

Referring to FIG. 8 it can be understood how synchronous arrival is maintained should a tramcar be delayed. It will be noted that FIG. 8 duplicates FIG. 4 except that a delay event has been introduced in front of tramcar "c". In response to the delay event the operator will deactivate the accelerator 10 which will cause the tramcar to decelerate at a predetermined deceleration rate; if necessary, the operator will also depress the brake pedal 11 which will cause the tramcar to decelerate more rapidly; if the operator engages the brake pedal in a panic stop, the tramcar brake system will be automatically applied in a predetermined sequence to bring the tramcar to a complete stop as safely as possible. In either of these cases, when the delay event is removed, the operator will again activate the accelerator 10, and the onboard processor 5, based on time and distance remaining to the next stop boarding area, will calculate a new speed to arrive at the scheduled time "Ts#", and cause the motor controller 6 to accelerate the tramcar, at its preset acceleration rate, to that calculated speed. In this case, it will be understood that, in spite of the delay, tramcar "c" will, by accelerating to a higher speed, still arrive at stop boarding area "S2" at time "Ts#" synchronously with tramcar "a".

Referring to FIG. 8 it can be understood that the system shown and described will operate continuously, with synchronous arrivals at stop boarding areas, as long as any delayed tramcar, after the delay is removed, is able to accelerate to a speed fast enough to arrive at schedule time "Ts#". If the recovery speed calculated for the tramcar to accelerate to exceeds a predetermined safe maximum speed, the tramcar will only accelerate to that safe maximum speed and, consequently, will arrive later than schedule time "Ts#".

Referring to FIG. 9 it can be understood how synchronous arrival is maintained if a delayed tramcar, having accelerated to safe maximum speed, is nevertheless going to arrive late. It will be noted that FIG. 9 duplicates FIG. 8 except that when the delay event is removed and the tramcar accelerates to the predetermined safe maximum speed, it will arrive after schedule time "Ts#". By comparing time and distance remaining to the next stop boarding area, the onboard processor calculates the time "Ts#+x" it will actually arrive, where "x" is a number of seconds after schedule time "Ts#", and transmits this actual arrival time to the central control processor 18. It will be understood with reference to FIG. 1*a* that the transmitting and receiving of information between tramcars and the central control processor occurs via the transceivers located respectively onboard the tramcars and in the central control facility; for the sake of brevity, this reference to transceivers will be omitted. The central processor, having received the actual arrival time "Ts#+x" from tramcar "c", and by virtue of its preprogramming, identifies the appropriate opposing tramcar in the system, in this case tramcar "a", and transmits a new, one-stop-only, arrival time "Ts#+x" to that opposing tramcar's onboard processor. The opposing tramcar's onboard processor then, using its time and distance remaining to the next stop boarding area, calculates a new, slower, speed which will cause it to arrive at the new, one-stop-only, arrival time "Ts#+x", and the motor controller 6 will decelerate to that calculated speed. Thus it will be understood that both the delayed tramcar "c" and its opposing tramcar "a" will still arrive synchronously at the stop boarding area "S2", but now this synchronous arrival will be at time "Ts#+x" instead of "Ts#".

Looking at FIGS. 9 and 10 together, it can be understood that tramcars "b" and "d" will have arrived synchronously at stop boarding area "S4" at schedule time "Ts#", whereas tramcars "a" and "c" are arriving synchronously at stop boarding area "S2" at a later time "Ts#+x". Consequently, tramcars "b" and "d", after their normal deboarding and boarding process may have departed stop boarding area "S4", as shown in FIG. 10, some time before tramcars "a" and "c" have completed their deboarding/boarding process at stop "S2". Referring to FIG. 10, it will be noted that the scheduled arrival time at the next stop boarding areas "S1", "S3" and "S4" is still the preprogrammed schedule time "Ts#". Referring to FIG. 10, it can be understood that tramcars "a" and "c", even though they are departing later than the other tramcars, can still arrive at their next stop boarding areas at the preprogrammed schedule time "Ts#" if, upon departure, they are able to accelerate to the speed calculated for that scheduled arrival time.

Still looking at FIGS. 9 and 10, it can thus be understood that the system shown and described can operate continuously, maintaining synchronous arrivals, even though a delay event, or events, causes one or more pairs of tramcars to arrive late, at a time "Ts#+x".

Referring to FIG. 11 it can be understood that if one or more of the late arriving tramcars, upon departing and accelerating to the predetermined safe maximum speed, cannot arrive at its next stop boarding area by schedule time "Ts#", this is treated as a delay event as before. In this case tramcar "a" is going to be late by "x" seconds to stop boarding area "S3" which causes its onboard processor to transmit this late arrival to the central processor 14 which, in turn, identifies the affected opposing tramcar "d" and transmits to its onboard processor the new arrival time "Ts#+x", which causes its motor controller to decelerate to the speed that will result in that arrival time.

Referring to FIGS. 9–11 together, it will be understood that a series of delay events can be allowed to build up in the system while still maintaining the synchronous arrival of opposing tramcars at any given stop boarding area. As the series of delay events build up, however, it can be understood that the time "x", which is being added to the various synchronous arrivals, will grow longer. At some point, the new arrival time "Ts#+x" will cause one or more of the tramcars to have to slow to such an extent, in order to arrive synchronously, that passengers will sense a significant degradation and inconvenience in the service.

Figures 12, 13:
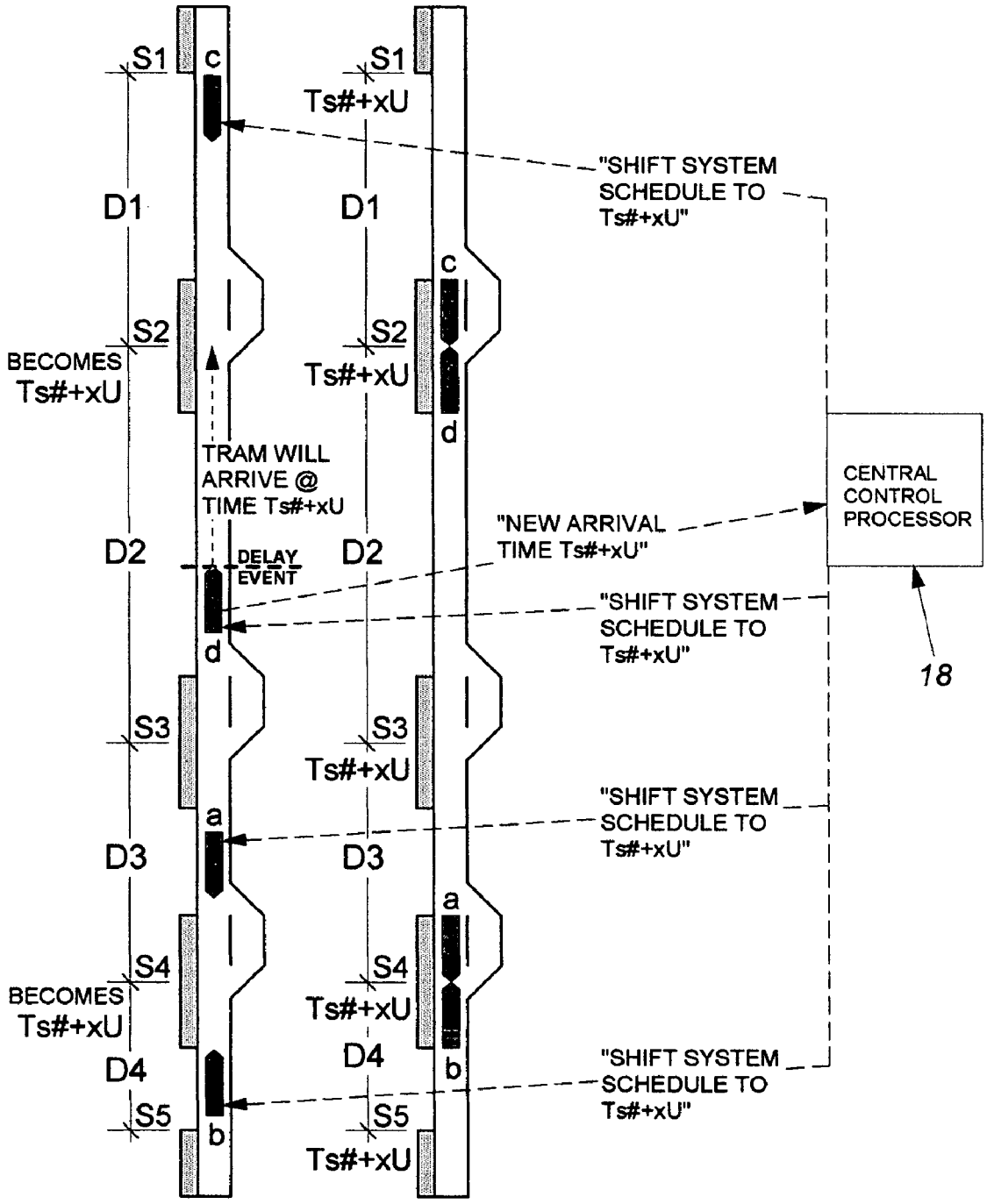

Referring to FIGS. 12 and 13 it can be understood how this significant service degradation and inconvenience is avoided as delay events build up in the system. As shown in FIGS. 12–13, the late arrival quantity "x" is given a predetermined and preprogrammed upset limit "$x^{U}$" in the central control processor 18. When the central control processor receives a late arrival transmission from a tramcar that equals or exceeds "Ts#+$x^{U}$", the central control processor transmits to all tramcar onboard processors in the system a system-wide schedule shift of "Ts#+$x^{U}$". Thus, it can be understood, all tramcars in the system will now adjust their speed to arrive at their next stop boarding area synchronous with the most delayed tramcar in the system. Referring to FIG. 12, it can be understood that the central control processor 18 has, in effect, shifted the entire system schedule to become "Ts#+$x^{U}$". Subsequently, as shown in FIG. 13, it can be seen that all tramcars in the system will now arrive synchronously at their next stop boarding area at the new, shifted, schedule time. Thus, the system, in essence, starts again, and continues to operate as previously illustrated and described, except that the system schedule time "Ts#" has been shifted forward by "$x^{U}$" seconds to absorb delays previously built up in the system.

Figures 14, 15, 16, 17, 18:
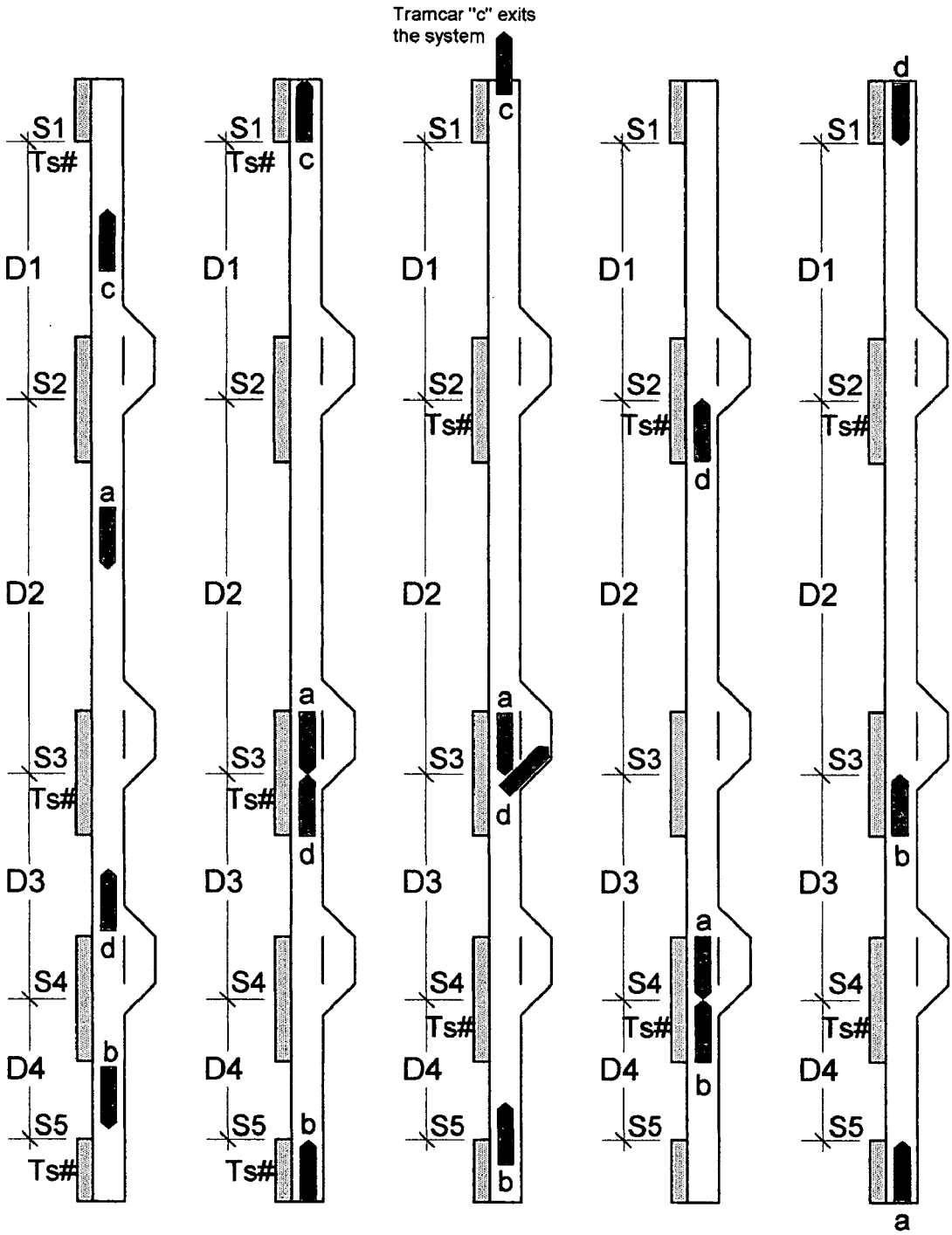

Referring to FIGS. 14–18, it can be understood how tramcars can be taken out of the system during operations, for example to reduce operational costs during periods of low demand, without disrupting the synchronous arrival dynamic. In FIG. 14 it will be seen that tramcar "c" is traveling towards endstop boarding area "S1", where it will arrive at system schedule time "Ts#" as shown in FIG. 15. During passenger deboarding at endstop "S1" waiting pedestrians are advised the tramcar is going out of service and to wait for the next arrival. After deboarding is complete, instead of reversing direction and departing back into the system, tramcar "c" exits the system at the endstop, as shown in FIG. 16. Referring to FIG. 16 it will be noted that tramcar "d" will be the next to arrive at endstop "S1", but that it will first stop at intermediate stop boarding area "S2" where, because tramcar "c" has departed the system, it will not arrive synchronously with an opposing tramcar, but will arrive and depart alone, as shown in FIG. 17. None-the-less, tramcar "d" will maintain the system schedule time "Ts#", and will next arrive synchronously with another tramcar at stop boarding area "S2", where it will meet tramcar "b", as inferred by FIG. 18.

Looking at FIGS. 14–18, it can be further understood that additional tramcars may be taken out of the system using the above method, and that the system will continue its synchronous arrivals according to schedule times "Ts#" as long as tramcars are removed such that there is maintained an odd number of empty stop boarding areas between opposing tramcars. It can also be understood that tramcars can be added back into the system by reversing the method just described.

Figures 19, 20, 21, 22:
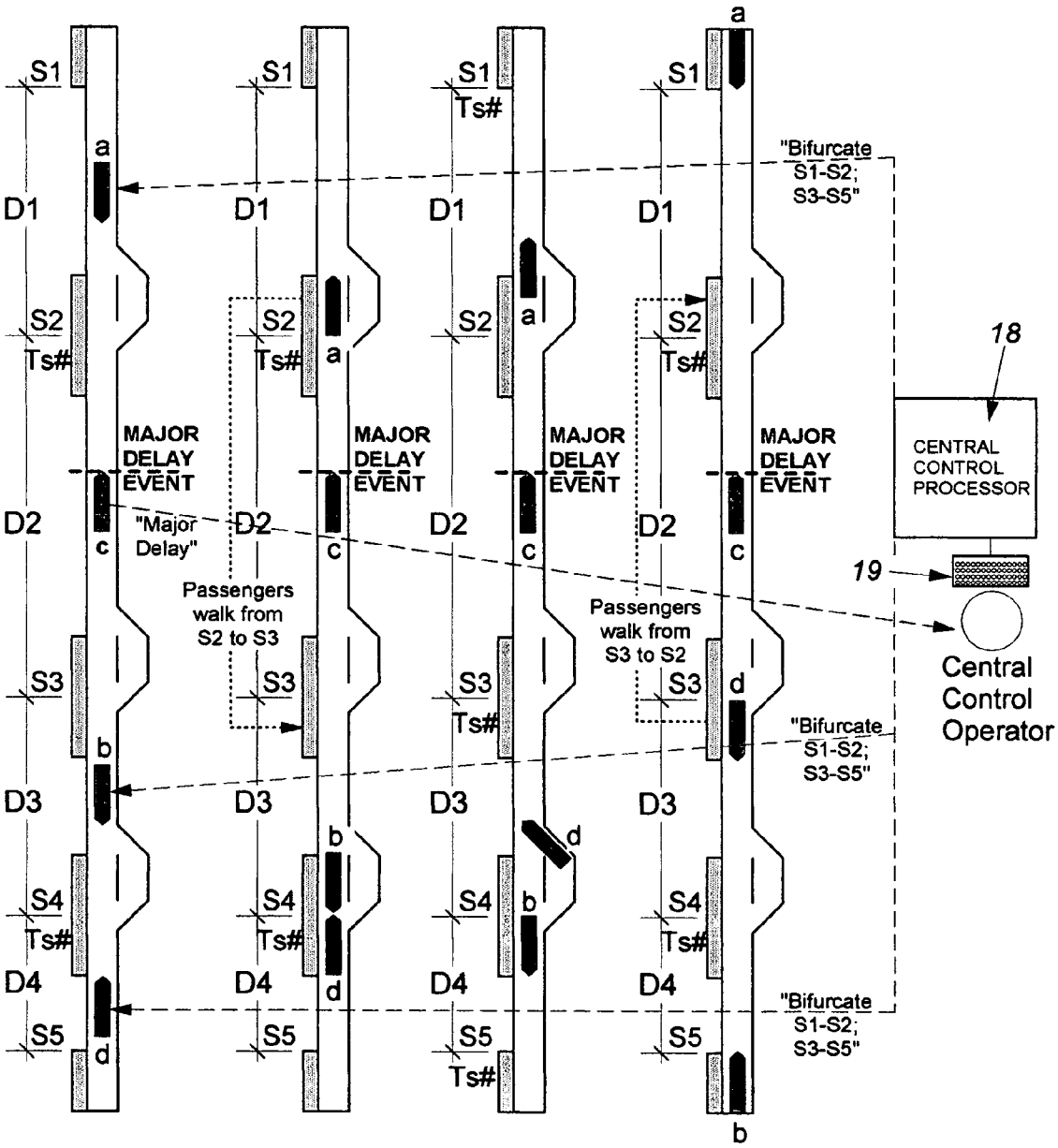

Referring to FIGS. 19–22, it can be understood how the system can bifurcate into two separate, independent systems in the event of a major delay along the guidelane caused, for example, by a disabled tramcar or a traffic accident. It will be understood that "major delay" will be defined by system operations as involving a period of time wherein it would be beneficial to bifurcate the system rather than have it sit idle until the delay is cleared. Referring to FIG. 19 it will be noted that tramcar "c" has encountered such a major delay. As indicated in the diagram, the operator of the delayed tramcar will notify a central control operator of the major delay. It will be understood that this communication can occur by any available communication means, including the on-board transceiver, cell-phone, etc. Having received information about the major delay, the central control operator will then use the input device 19 to input to the central control processor 18 the identification of the guidelane segment which is blocked, in this case segment "D2". The central control processor will then, according to a predetermined parameter set, prepare and transmit a "system bifurcation notice" to each of the tramcar onboard processors. The system bifurcation notice will identify the endstops of the two new systems. In this case "S1 and S2" will define the ends of one system, and "S3 and S5" will define the ends of the other.

Referring to FIG. 19, and with reference to previous descriptions of system operations, it will be understood that each tramcar's onboard processor is able to process this notice in terms of the time and distance remaining to its next stop boarding area. Tramcar "a", for example, "knows" that its next stop boarding area is "S2"; the onboard processor, therefore causes a message to appear on the operator's display informing him that the tramcar will reverse direction at the next stop boarding area, "S2", and thereafter operate in a bifurcated system between stops "S2" and "S1". The onboard processors on tramcars "b" and "d" will likewise make similar adjustments to operate in a bifurcated system between endstop boarding areas "S3" and "S5".

Referring to FIG. 20, it can be understood that the result of these adjustments is that tramcars "a", "b" and "d" have continued to their next stop boarding areas, and have arrived at schedule time "Ts#". Tramcar "a", however, following the bifurcation instruction, has reversed direction at stop "S2" and is prepared to depart back towards stop boarding area "S1". Tramcar "a" passengers who desired to continue toward stop "S5" will have been instructed to deboard and walk around the guidelane obstruction to stop "S3" where they will board approaching tramcar "d" when it next arrives, as shown in FIG. 21. Looking at FIG. 22, it can be seen that tramcar "d" has now arrived at stop "S3", reversed direction, and will depart towards stop "S5". Passengers who were on tramcar "d" who desired to continue toward stop "S1" will have been instructed to deboard at "S3" and walked around the obstructed guidelane to stop "S2" where they will board tramcar "a" the next time it arrives.

Looking again at FIGS. 19–22, it can thus be understood that even though the guidelane has been obstructed by a major delay, the system can continue to provide continuous synchronous arrival service through bifurcation, and that by walking between the stops on either side of the obstructed guidelane, passengers are still able to access the entire length of the system. It will be further understood that each of the bifurcated systems will operate according to the method previously described to maintain synchronous arrivals.

Figure 23:
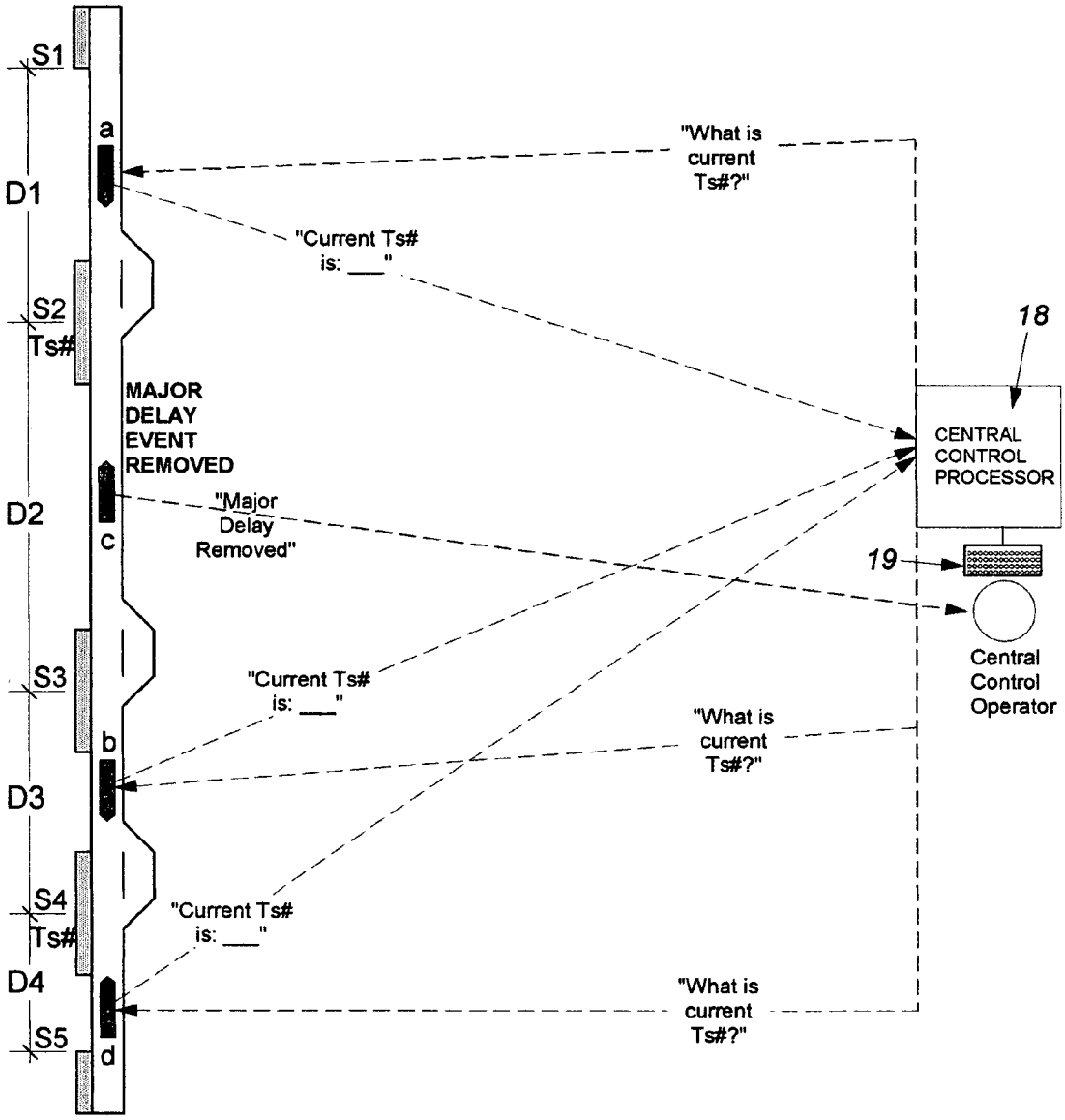

Referring to FIG. 23, it will be noted that the major delay in the guidelane has been removed, and tramcar "c" is able to proceed towards stop boarding area "S2". The bifurcated system, therefore, is reclosed as follows: Looking at FIG. 23, the operator of tramcar "c" has notified the central control operator that the major delay is ended and the tramcar is free to proceed. The operator of tramcar "c" will then actuate the tramcar accelerator 10 to move the tramcar to its next stop boarding area, in this case "S2". It will be understood that, at this point, tramcar "c" has no schedule time "Ts#" since it is not operating as part of either of the bifurcated systems. With the accelerator activated, then, the onboard processor will accelerate tramcar "c" to a default speed at which it will proceed to the next stop boarding area. It will also be understood that all passengers will have deboarded tramcar "c" during the major delay, so it will arrive at stop boarding area "S2" empty of passengers.

Referring to FIG. 23 it will be understood that the central control operator, having been notified the major delay has been removed, will utilize the input device 19 to input to the central control processor 18 the identity of the guidelane segment which has now been unblocked, causing the central control processor, according to a predetermined set of parameters, to initiate a "reclosure" procedure. As shown in FIG. 23, the "reclosure" procedure begins with the central control processor transmitting a signal to all the tramcar onboard processors causing them to transmit back their present schedule time "Ts#".

Continuing to consider FIG. 23, it can be understood that each of the bifurcated systems, while synchronizing independently during the major delay, may have experienced and absorbed its own delay events independent of the other system. The totality of tramcars may therefore be poorly positioned to synchronously "reclose" the system. When the central control processor receives the present schedule time "Ts#" from each tramcar, therefore, by virtue of its preprogramming, it calculates an optimum tramcar positioning and new start-up time "T" for the system reclosure, and transmits this "reclosure notice" to each tramcar's onboard processor, which also causes this information to be displayed on the operators cockpit display 12. It can be understood that this "optimum" reclosure set-up is one which will cause the least delay in the system's service.

Figures 24, 25, 26, 27:
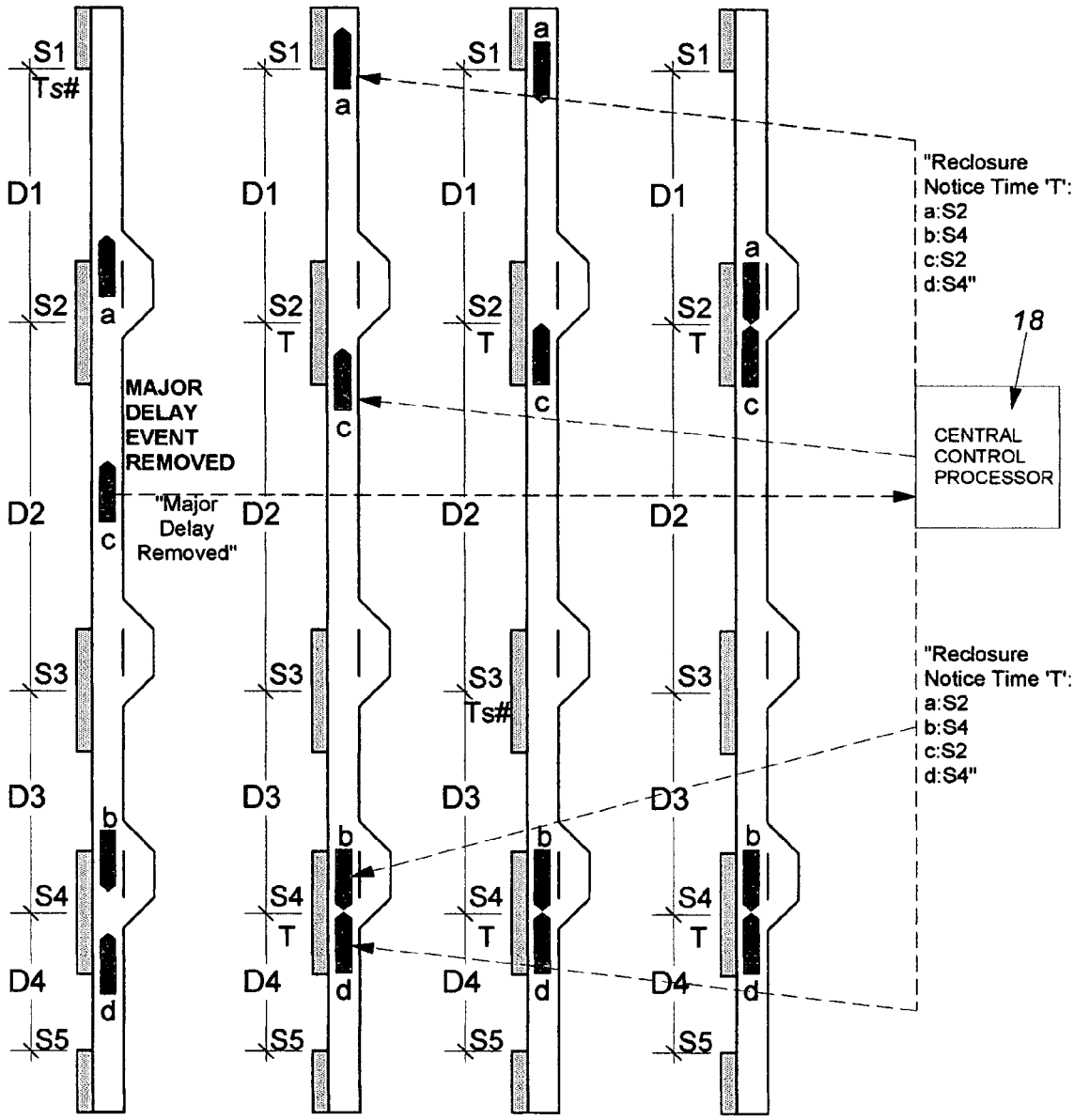

The above described reclosure process can be understood with reference to FIGS. 24–27 as follows: Looking at FIG. 24 it can be seen that when the major delay event is removed the system, as a whole, is poorly positioned for synchronous reclosure. Tramcar "a" has just departed stop boarding area "S2" going towards stop "S1"; when tramcar "c" arrives at stop "S2", therefore, it will have to wait until tramcar "a" returns before it can bypass and proceed. Similarly, tramcars "b" and "d" are approaching stop boarding area "S4". Even though they will arrive synchronously at stop "S4", as shown in FIG. 25, they cannot bypass and continue, but must also wait until tramcar "a" has returned back to stop "S2". (If they "b" and "d" did bypass and continue, "d" and "a" would, in the next sequence, be facing each other without an empty stop boarding area between them.)

Looking again at FIG. 24, and with reference to FIG. 23, it can be understood that when the central control processor 18 requests and receives the present schedule time "Ts#" for each of the tramcars, it is able to calculate, using the parameters just outlined, that the earliest next start-up time for the system as a whole will be the time that tramcar "a" arrives back at stop boarding area "S2"; and further that at this startup time, tramcars "a" and "c" will be positioned at stop boarding area "S2", and tramcars "b" and "d" will be positioned at stop "S4". This information, then, becomes the operative content of the "reclosure notice" which the central control processor transmits to all the tramcar onboard processors. Having received this notice, therefore, tramcar "c" waits at stop "S2" and tramcars "b" and "d" wait at stop "S4" until new schedule time "T" which is the same as the time tramcar "a" will arrive back at stop "S2". Thus, as shown in FIG. 27, when tramcar "a" arrives at stop boarding area "S2" at time "T", all the tramcars will open their doors, commence boarding-deboarding procedures, and commence synchronous operations as earlier described.

Figure 28:
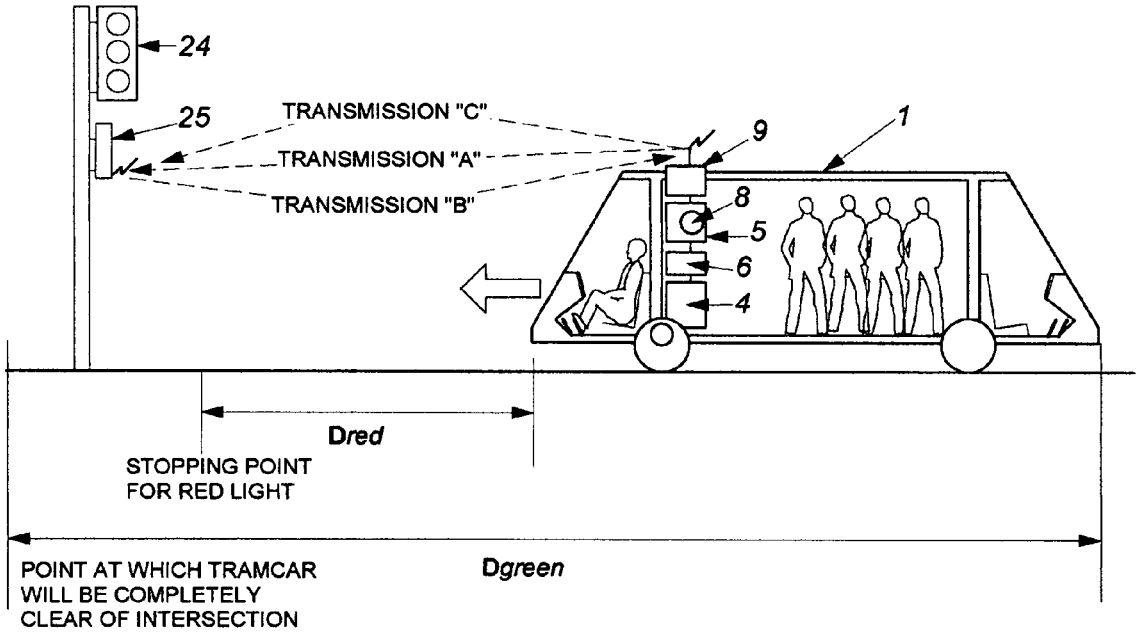
FIG. 28 is a diagrammatic side view of a tramcar approaching a signalized intersection.

Referring to FIG. 28 it can be understood how the system can traverse signalized intersections without being unduly delayed by red traffic lights, or without causing random, frequent traffic-light cycling which would unduly disrupt the flow of other vehicular traffic. FIG. 28 depicts a tramcar 1 traveling in a direction indicated by the arrow, approaching the traffic light 24 of a signalized intersection, the traffic light cycle being controlled by a signal-controller 25 which has an integrated transceiver. FIG. 28 further indicates a distance "Dred" which is measured from the front of the tramcar 1 to the point at which the tramcar would have to stop to keep from running a red-light.

Referring to FIG. 28, and with reference to earlier descriptions, it can be understood that the onboard processor 5 is pre-programmed with the speed-dependant distance "Dred" at which it must make a decision if the traffic-light is red, in the same way it is preprogrammed with the distances between tramstop boarding areas. When the tramcar reaches the distance "Dred" from the red-light stopping point of the intersection, then, the onboard processor causes the transceiver 9 to send a signal to the traffic-light controller 25, here depicted as "Transmission 'a'". This transmission causes the traffic-light controller to respond with "Transmission 'b'" which provides the onboard processor with two data inputs: (a) Traffic-light is red (green); (b) Traffic-light will cycle in x seconds. Using this data input, it can be understood that the onboard processor 5 can make the following determinations and then respond according to predetermined parameters:

If "Transmission 'b'" indicates the traffic-light is red, the onboard processor will compare the time the light is going to cycle green with the time the tramcar will arrive at the intersection stopping point (traverse distance "Dred.") at its present speed. If the light is going to cycle green before the tramcar arrives, the onboard processor takes no action; the tramcar continues at its present speed, the light cycles to green, and the tramcar proceeds through the intersection.

If, at its present speed, the tramcar is going to arrive at the intersection before the light is going to cycle green, the onboard processor calculates a slower speed which will cause the tramcar to arrive after the light cycles green, enabling it to proceed through the intersection. If this slower speed is equal to or greater than a predetermined minimum allowed speed, the onboard processor causes the motor controller 6 to slow the tramcar to the calculated speed.

If the calculated slower speed, described above, is less than a predetermined minimum allowed speed, the onboard processor causes the motor controller to slow the tramcar to the minimum allowed speed, calculates the no. of seconds it will then arrive before the light cycles green, and transmits a signal to the traffic-light controller 25, here depicted as "Transmission 'c'", instructing it to cycle green the appropriate number of seconds early. In this case the tramcar has pre-empted the signal, but has slowed to minimize the pre-emption.

If "Transmission 'b'" indicates the traffic-light is green, the onboard processor will compare the time the light is going to cycle red with the time the tramcar will completely clear the opposite side of the intersection (traverse distance "Dgreen") at its present speed. If the light is going to cycle red after the tramcar has cleared the intersection, the onboard processor takes no action; the tramcar continues at its present speed and proceeds through the intersection with the green light.

If, at its present speed, the tramcar is not going to clear the intersection before the light cycles red, the tramcar continues at its present speed, and the onboard processor transmits a signal to the traffic-light controller 25, depicted as "Transmission 'c'", instructing it to remain green for the additional number of seconds required for the tramcar to clear the intersection.

Referring to FIG. 28, and with reference to the above description, it can thus be understood that the tramcars are able to traverse signalized intersections without having to slow below their predetermined minimum speed. Furthermore, the tramcars avoid signal pre-emption whenever possible by slowing their speed, and when they must invoke preemption, the signal cycle is interrupted for the minimum amount of time possible.

While the foregoing specification and drawings describe the major components and method of operations of a preferred embodiment of the instant invention, it is to be understood that I do not intend to limit myself to the precise arrangements herein disclosed, since various details of arrangement, form and method may obviously be developed by anyone skilled in the art without departing from the basic principles and novel teachings of this invention and without sacrificing any of the advantages of the invention, and accordingly I intend to encompass all changes, variations, modifications and equivalents falling within the scope of the appended claims.

What is claimed is:

1. A method of coordinating the movement of a system of a plurality of oppositely directed tramcars operating along a single guidelane, comprising:

(a) positioning a plurality of fixed stop-boarding areas along the guidelane;

(b) locating corresponding by-pass lanes in association with at least some of the stop-boarding areas;

(c) calculating a predetermined arrival time for each tramcar at each stop-boarding area, such that oppositely moving pairs of tramcars approaching a common stop-boarding area will arrive at approximately the same time;

(d) utilizing a processor onboard each tramcar to calculate the distance remaining to the next stop-boarding area, and the time remaining until the predetermined arrival time at the next stop-boarding area;

(e) utilizing a processor onboard each tramcar, with a known time and distance remaining to the next stop-boarding area, to adjust the speed of that tramcar, such that it will arrive at approximately the predetermined arrival time;

(f) utilizing an on-board odometer to determine the distance each tramcar has traveled since leaving the previous stop-boarding area.

2. The method of claim 1, including directing one of the pair of tramcars having arrived at, or about to arrive at, a mutual stop-boarding area into a bypass lane, allowing the other of the pair of tramcars to continue along the guidelane, thus enabling the pair of tramcars to pass each other.

3. The method of claim 1, including utilizing an onboard odometer to determine the distance each tramcar has traveled since the commencement of operations.

4. The method of claim 1, including utilizing an onboard electronic clock to determine the amount of time elapsed since commencement of operations.

5. The method of claim 1, including utilizing an onboard electronic clock to determine the amount of time elapsed since leaving the previous stop-boarding area.

6. A method of coordinating the movement of a system of a plurality of oppositely directed tramcars operating along a single guidelane, comprising:

(a) positioning a plurality of fixed stop-boarding areas along the guidelane;

(b) locating corresponding by-pass lanes in association with at least some of the stop-boarding areas;

(c) calculating a predetermined arrival time for each tramcar at each stop-boarding area, such that oppositely moving pairs of tramcars approaching a common stop-boarding area will arrive at approximately the same time;

(d) utilizing a processor onboard each tramcar to calculate the distance remaining to the next stop-boarding area, and the time remaining until the predetermined arrival time at the next stop-boarding area;

(e) utilizing a processor onboard each tramcar, with a known time and distance remaining to the next stop-boarding area, to adjust the speed of that tramcar, such that it will arrive at approximately the predetermined arrival time; and (f) utilizing an onboard governor to control tramcar acceleration and decelaration such that acceleration and deceleration occur at a predetermined rate.

7. The method of claim 1, including assigning a maximum allowable speed for tramcars in each guidelane segment between stop-boarding areas.

8. The method of claim 7, including utilizing an onboard processor to determine in which guidelane segment the tramcar is located and calculate the speed required to reach the next stop-boarding area at the predetermined time, and compare that calculated speed to the maximum allowable speed for the segment.

9. The method of claim 7, including utilizing an onboard processor to calculate the number of seconds late the tramcar will arrive at the next stop-boarding area if it accelerates to the maximum allowable speed, and an on-board transmitter to communicate the number of seconds it will be late to a central processor/transmitter.

10. The method of claim 7, including utilizing a central processor/transmitter to communicate a delayed arrival time to an onboard tramcar processor, causing that tramcar to decelerate to a speed such that the tramcar will arrive at a mutual stop-boarding area at approximately the same time as its opposing tramcar.

11. The method of claim 1, including utilizing a central processor/transmitter to calculate a system-wide shift in the predetermined arrival times for all tramcars at all stop-boarding areas, and communicating this shift to all onboard tramcar processors, causing all tramcars to alter speed to arrive at their next stop-boarding area at the new predetermined arrival times.

12. The method of claim 2, including commencing operations with tramcars pre-positioned at stop-boarding areas such that when they commence operations and, if necessary, make an initial bypass of another tramcar, there will be an odd number, and at least one, empty stop-boarding areas between each pair of opposing tramcars.

13. The method of claim 2, including removing tramcars from the system at a predetermined stop-boarding area according to a predetermined sequence, such that the tramcars remaining will continue to have at least one—and always an odd number—of empty stop-boarding areas between any two opposing pairs of tramcars.

14. The method of claim 13, including adding tramcars back into the system according to a predetermined sequence, such that there will continue to be at least one—and always an odd number—of empty stop-boarding areas between any two opposing pairs of tramcars.

15. The method of claim 13, including utilizing a central processor/transmitter to calculate the schedule of arrival times at each stop-boarding area for a tramcar being added into the system, and to communicate this schedule of arrival times to the onboard processor in the said tramcar.

16. The method of claim 1, including bifurcating the system into a plurality of subsystems.

17. The method of claim 16, including utilizing a central processor/transmitter communicating to all the tramcars operating in the system that the system is to be bifurcated.

18. The method of claim 16, including utilizing a central processor/transmitter to determine the end-stop-boarding areas of the new subsystems on each side of the bifurcation point, and to calculate a new schedule of arrival times for each tramcar at each stop-boarding area for each subsystem; and communicate this information data to the onboard processor of each respective tramcar.

19. The method of claim 16, including utilizing a central processor/transmitter to establish a new start-up time for the new subsystems on each side of the bifurcation point, and communicating that start-up time to the tramcars in each system.

20. The method of claim 16, including utilizing a central processor/transmitter to establish a new start-up time to rejoin the bifurcated subsystems into a single system.

21. The method of claim 20, including utilizing the central processor/transmitter to calculate a new schedule of arrival times for each tramcar at each stop-boarding area, and communicate the schedule of arrival times to the onboard processor for each respective tramcar.

22. The method of claim 1, including utilizing a communicator at each stop-boarding area which communicates to waiting passengers the time remaining until the next tramcar arrives.

23. The method of claim 22, including utilizing a central processor/transmitter to calculate the time until the next tramcar arrives at each stop-boarding area, and communicates that time to the communicator at each respective stop-boarding area, causing the information to be conveyed.

24. The method of claim 22, including utilizing a central processor/transmitter to communicate to each stop-boarding area communicator that the system is to be bifurcated, and cause the communicator to convey the new end-stop-boarding areas on each side of the bifurcation point, and the next arrival time for each tramcar at each stop-boarding area.

25. The method of claim 1, including predetermining a minimum dwell-time each tramcar will dwell at a stop-boarding area.

26. The method of claim 1, including predetermining the maximum dwell-time each tramcar will dwell at a stop-boarding area.

27. The method of claim 1, including utilizing driver operated tramcars with driver controls.

28. The method of claim 27, wherein the driver controls comprise an actuator such that when said actuator is engaged, the tramcar accelerates at a predetermined rate of acceleration to a speed calculated by the onboard processor; and when the actuator is disengaged, the tramcar decelerates, and continues to decelerate, at a predetermined rate of deceleration until a full stop is reached.

29. The method of claim 28, including utilizing further driver controls comprising a brake pedal such that when the brake pedal is engaged, tramcar brakes are applied commensurate with the pressure on the pedal applied by the driver; and such that if the driver applies a "panic" pressure, tramcar brakes are applied in a predetermined sequence of pressures to optimize safety.

30. The method of claim 1, including utilizing tramcars which operate on fixed rails, causing the tramcars to follow the path of the rails.

31. The method of claim 1, including utilizing tramcars with a terrestrial guide steering means which follows a terrestrial guide, or target, located in or on the surface of the guidelane.

32. The method of claim 31, in which the terrestrial guide steering means comprises an optical sensor located on the tramcar which causes the tramcar to follow an optical guide target located in or on the surface of the guidelane.

33. The method of claim 31 in which the terrestrial guide steering means comprises a magnetic sensor located on the tramcar which causes the tramcar to follow a magnetic guide target located in or one the surface of the guidelane.

34. The method of claim 31 in which the terrestrial guide steering means comprises an electromagnetic sensor located on the tramcar which causes the tramcar to follow an electromagnetic guide target located in or one the surface of the guidelane.

35. The method of claim 1, including utilizing tramcars which are bidirectional, capable of reversing direction at an end stop-boarding area.

36. The method of claim 35, including providing driver controls in driver cockpits at each end of the tramcar, enabling the driver to control the tramcar from either cockpit.

37. The method of claim 36, including utilizing conventional driver steering means, acceleration and braking control, in at least one of the driver cockpits, such that the tramcar can be driven out of the guidelane to a remote storage or maintenance facility.

38. The method of claim 1, in which a traffic light controller at a signalized intersection includes a transceiver, and the processor on board each tramcar communicates with the transceiver to determine when the traffic light is going to cycle such that, when necessary, the on board processor preempts the traffic light, causing the controller to modify its cycle, enabling the tramcar to enter and clear the intersection without having to stop.

39. The method of claim 38, in which the processor on board a tramcar approaching a red traffic light, causes the tramcar to decelerate to a speed such that the traffic light will change to green during its normal cycle before the tramcar arrives at the intersection, thus avoiding the need to preempt the traffic light.

40. The method of claim 38, in which there is a predetermined minimum speed the on board processor will allow a tramcar to decelerate to in order to avoid preempting a traffic light.

41. The method of claim 38, in which the processor an board a tramcar approaching a green traffic light which is about to change to red, causes the traffic light controller to maintain the green light until the tramcar has safely entered and cleared the intersection.

* * * * *